US011282449B2

(12) United States Patent
Chang et al.

(10) Patent No.: US 11,282,449 B2
(45) Date of Patent: Mar. 22, 2022

(54) DISPLAY PANEL ADJUSTMENT FROM TEMPERATURE PREDICTION

(71) Applicant: Apple Inc., Cupertino, CA (US)

(72) Inventors: Sun Il Chang, San Jose, CA (US); Hung Sheng Lin, San Jose, CA (US); Hyunwoo Nho, Stanford, CA (US); Jie Won Ryu, Campbell, CA (US); Junhua Tan, Santa Clara, CA (US); Chih-Wei Yeh, Campbell, CA (US); Chaohao Wang, Sunnyvale, CA (US); Paolo Sacchetto, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 469 days.

(21) Appl. No.: 15/674,208

(22) Filed: Aug. 10, 2017

(65) Prior Publication Data

US 2018/0082631 A1 Mar. 22, 2018

Related U.S. Application Data

(60) Provisional application No. 62/398,083, filed on Sep. 22, 2016.

(51) Int. Cl.

| | |
|---|---|
| ***G09G 3/3225*** | (2016.01) |
| ***G09G 3/20*** | (2006.01) |
| ***G09G 3/36*** | (2006.01) |

(52) U.S. Cl.

CPC ..... *G09G 3/3225* (2013.01); *G09G 3/20* (2013.01); *G09G 3/3648* (2013.01);
(Continued)

(58) Field of Classification Search

None

See application file for complete search history.

(56) References Cited

U.S. PATENT DOCUMENTS

| | | | |
|---|---|---|---|
| 7,420,538 | B2 | 9/2008 | Murao et al. |
| 8,687,026 | B2 | 4/2014 | Wurzel et al. |

(Continued)

FOREIGN PATENT DOCUMENTS

| | | | |
|---|---|---|---|
| CN | 102761510 | A | 10/2012 |
| CN | 203051435 | A | 4/2013 |

(Continued)

OTHER PUBLICATIONS

Invitation to Pay Additional Fees and Partial International Search for PCT Application No. PCT/US2017/049776 dated Nov. 20, 2017; 21 pgs.

(Continued)

*Primary Examiner* — Amare Mengistu
*Assistant Examiner* — Sarvesh J Nadkarni
(74) *Attorney, Agent, or Firm* — Fletcher Yoder P.C.

(57) ABSTRACT

Systems, methods, and devices for adjusting image display on an electronic display by predicting a temperature change of the electronic display due to heat-producing components near the display or due to changes in content. An electronic device may include an electronic display and processing circuitry. The electronic display may include pixels with behaviors that vary with temperature. As such, the processing circuitry may generate image data to send to the electronic display and adjust the image data or vary an operation of the electronic display based at least in part on a predicted temperature effect on at least part of the active area of the electronic display. The processing circuitry may determine the predicted temperature effect at least in part due to a first heat producing component or changes in content of the image data.

21 Claims, 14 Drawing Sheets

(52) U.S. Cl.
CPC ..... *G09G 2320/0233* (2013.01); *G09G 2320/0285* (2013.01); *G09G 2320/0295* (2013.01); *G09G 2320/041* (2013.01); *G09G 2320/0646* (2013.01); *G09G 2320/0693* (2013.01); *G09G 2340/0435* (2013.01); *G09G 2340/16* (2013.01); *G09G 2360/16* (2013.01)

(56) References Cited

U.S. PATENT DOCUMENTS

| | | | | |
|---|---|---|---|---|
| 8,891,466 | B2 | 11/2014 | Hsieh et al. | |
| 2003/0010894 | A1* | 1/2003 | Yoshihara | G09G 3/3611 250/208.1 |
| 2005/0264701 | A1* | 12/2005 | Huh | H04N 9/73 348/655 |
| 2006/0232512 | A1* | 10/2006 | Kim | G09G 3/204 345/60 |
| 2007/0222738 | A1 | 9/2007 | Yoshida | |
| 2007/0273787 | A1* | 11/2007 | Ogino | H04N 7/015 348/441 |
| 2008/0204481 | A1* | 8/2008 | Mostinski | G09G 3/36 345/690 |
| 2011/0127026 | A1 | 6/2011 | Schuch et al. | |
| 2012/0162229 | A1* | 6/2012 | Yamato | G09G 3/2011 345/428 |
| 2013/0169615 | A1 | 7/2013 | Kobayashi et al. | |
| 2013/0321361 | A1 | 12/2013 | Lynch et al. | |
| 2014/0292835 | A1 | 10/2014 | Matsushima et al. | |
| 2014/0307168 | A1* | 10/2014 | Law | G09G 5/12 348/500 |
| 2015/0145896 | A1 | 5/2015 | Kim et al. | |
| 2015/0154910 | A1* | 6/2015 | Okuno | G09G 3/3258 345/212 |
| 2016/0189688 | A1* | 6/2016 | Morein | G09G 5/39 345/545 |
| 2016/0196789 | A1* | 7/2016 | Suyama | G09G 3/3688 345/209 |
| 2016/0275916 | A1* | 9/2016 | Glen | G09G 5/395 |
| 2016/0293102 | A1 | 10/2016 | Chaji | |
| 2016/0323070 | A1 | 11/2016 | Chen et al. | |
| 2016/0351097 | A1* | 12/2016 | Sato | G09G 3/344 |
| 2016/0366353 | A1* | 12/2016 | Kobayashi | G06T 5/009 |
| 2017/0092196 | A1* | 3/2017 | Gupta | G09G 3/3266 |
| 2017/0164350 | A1 | 6/2017 | Sun et al. | |

FOREIGN PATENT DOCUMENTS

| | | | |
|---|---|---|---|
| CN | 102968961 | B | 4/2015 |
| CN | 106538039 | A | 3/2017 |
| EP | 1389847 | A1 | 2/2004 |
| EP | 2642475 | A1 | 9/2013 |
| WO | 2007/097299 | A1 | 8/2007 |
| WO | 2013124345 | A1 | 8/2013 |
| WO | 2016173637 | A1 | 11/2016 |

OTHER PUBLICATIONS

European Office Action for European Patent Application No. 17777673.98 dated Jul. 10, 2020; 12 pgs.
Chinese Search Report for Chinese Patent Application No. 2018800134958 dated Jul. 14, 2021; 12 pgs.

* cited by examiner

DISPLAY PANEL ADJUSTMENT FROM TEMPERATURE PREDICTION

CROSS REFERENCE TO RELATED APPLICATIONS

This application is a Non-Provisional Patent Application of U.S. Provisional Patent Application No. 62/398,083, entitled "Display Panel Adjustment from Temperature Prediction", filed Sep. 22, 2016, which is herein incorporated by reference in its entirety for all purposes.

BACKGROUND

The disclosure relates to adjusting display of images on an electronic display based at least in part on predicted temperature change of the electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices—such as televisions, portable phones, computers, vehicle dashboards, and more—include electronic displays. As electronic displays gain increasing higher resolutions and dynamic ranges, they also may become more susceptible to environmental changes such as changes in temperature. Thermal variations across an electronic display could cause different pixels to exhibit different display behaviors. While display panel sensing can be used to determine corrections to image data displayed on the electronic display, under certain conditions, the electronic display may experience changes in temperature faster than display panel sensing can handle.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Under certain conditions, display panel sensing may be too slow to identify operational variations due to thermal variations on an electronic display. For instance, when a refresh rate of the electronic display is set to a low refresh rate to save power, it is possible that portions of the electronic display could change temperature faster than could be detected through display panel sensing. To avoid visual artifacts that could occur due to these temperature changes, a predicted temperature effect may be used to adjust the operation of the electronic display.

In one example, an electronic device may store a prediction lookup table associated with independent heat-producing components of the electronic device that may create temperature variations on the electronic display. These heat-producing components could include, for example, a camera and its associated image signal processing (ISP) circuitry, wireless communication circuitry, data processing circuitry, and the like. Since these heat-producing components may operate independently, there may be a different heat source prediction lookup table for each one. In some cases, an abbreviated form of display panel sensing may be performed in which a reduced number of areas of the display panel are sensed. The reduced number of areas may correspond to portions of the display panel that are most likely to be affected by each heat source. In this way, a maximum temperature effect that may be indicated by the heat source predication lookup tables may be compared to actual sensed conditions on the electronic display and scaled accordingly. The individual effects of the predictions of the individual heat source lookup tables may be additively combined into a correction lookup table to correct for image display artifacts due to heat from the various independent heat sources.

In addition, the image content itself that is displayed on a display could cause a local change in temperature when content of an image frame changes. For example, when a dark part of an image being displayed on the electronic display suddenly becomes very bright, that part of the electronic display may rapidly increase in temperature. Likewise, when a bright part of an image being displayed on the electronic display suddenly becomes very dark, that part of the electronic display may rapidly decrease in temperature. If these changes in temperature occur faster than would be identified by display panel sensing, display panel sensing alone may not adequately identify and correct for the change in temperature due to the change in image content.

Accordingly, this disclosure also discusses taking corrective action based on temperature changes due to changes in display panel content. For instance, blocks of the image frames to be displayed on the electronic display may be analyzed for changes in content from frame to frame. Based on the change in content, a rate of change in temperature over time may be predicted. The predicted rate of the temperature change over time may be used to estimate when the change in temperature is likely to be substantial enough to produce a visual artifact on the electronic display. Thus, to avoid displaying a visual artifact, the electronic display may be refreshed sooner that it would have otherwise been refreshed to allow the display panel to display new image data that has been adjusted to compensate for the new display temperature.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
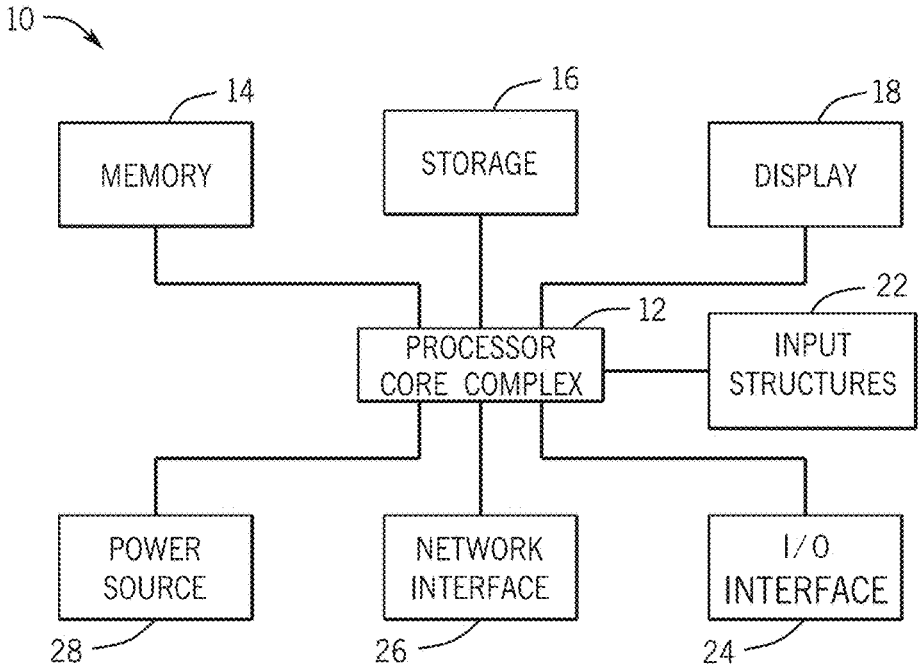
FIG. 1 is a schematic block diagram of an electronic device that performs display sensing and compensation, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

As noted above, display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. By sensing certain operational properties of the pixels, the image data may be adjusted to compensate for the operational variations across the display.

Display panel sensing involves programming certain pixels with test data and measuring a response by the pixels to the test data. The response by a pixel to test data may indicate how that pixel will perform when programmed with actual image data. In this disclosure, pixels that are currently being tested using the test data are referred to as "test pixels" and the response by the test pixels to the test data is referred to as a "test signal." The test signal is sensed from a "sense line" of the electronic display. In some cases, the sense line may serve a dual purpose on the display panel. For example, data lines of the display that are used to program pixels of the display with image data may also serve as sense lines during display panel sensing.

Under certain conditions, display panel sensing may be too slow to identify operational variations due to thermal variations on an electronic display. For instance, when a refresh rate of the electronic display is set to a low refresh rate to save power, it is possible that portions of the electronic display could change temperature faster than could be detected through display panel sensing. To avoid visual artifacts that could occur due to these temperature changes, a predicted temperature effect may be used to adjust the operation of the electronic display.

In one example, an electronic device may store a prediction lookup table associated with independent heat-producing components of the electronic device that may create temperature variations on the electronic display. These heat-producing components could include, for example, a camera and its associated image signal processing (ISP) circuitry, wireless communication circuitry, data processing circuitry, and the like. Since these heat-producing components may operate independently, there may be a different heat source prediction lookup table for each one. In some cases, an abbreviated form of display panel sensing may be performed in which a reduced number of areas of the display panel are sensed. The reduced number of areas may correspond to portions of the display panel that are most likely to be affected by each heat source. In this way, a maximum temperature effect that may be indicated by the heat source predication lookup tables may be compared to actual sensed conditions on the electronic display and scaled accordingly. The individual effects of the predictions of the individual heat source lookup tables may be additively combined into a correction lookup table to correct for image display artifacts due to heat from the various independent heat sources.

In addition, the image content itself that is displayed on a display could cause a local change in temperature when content of an image frame changes. For example, when a dark part of an image being displayed on the electronic display suddenly becomes very bright, that part of the electronic display may rapidly increase in temperature. Likewise, when a bright part of an image being displayed on the electronic display suddenly becomes very dark, that part of the electronic display may rapidly decrease in temperature. If these changes in temperature occur faster than would be identified by display panel sensing, display panel sensing alone may not adequately identify and correct for the change in temperature due to the change in image content.

Accordingly, this disclosure also discusses taking corrective action based on temperature changes due to changes in display panel content. For instance, blocks of the image frames to be displayed on the electronic display may be analyzed for changes in content from frame to frame. Based on the change in content, a rate of change in temperature over time may be predicted. The predicted rate of the temperature change over time may be used to estimate when the change in temperature is likely to be substantial enough to produce a visual artifact on the electronic display. Thus, to avoid displaying a visual artifact, the electronic display may be refreshed sooner that it would have otherwise been refreshed to allow the display panel to display new image data that has been adjusted to compensate for the new display temperature.

Figure 2:
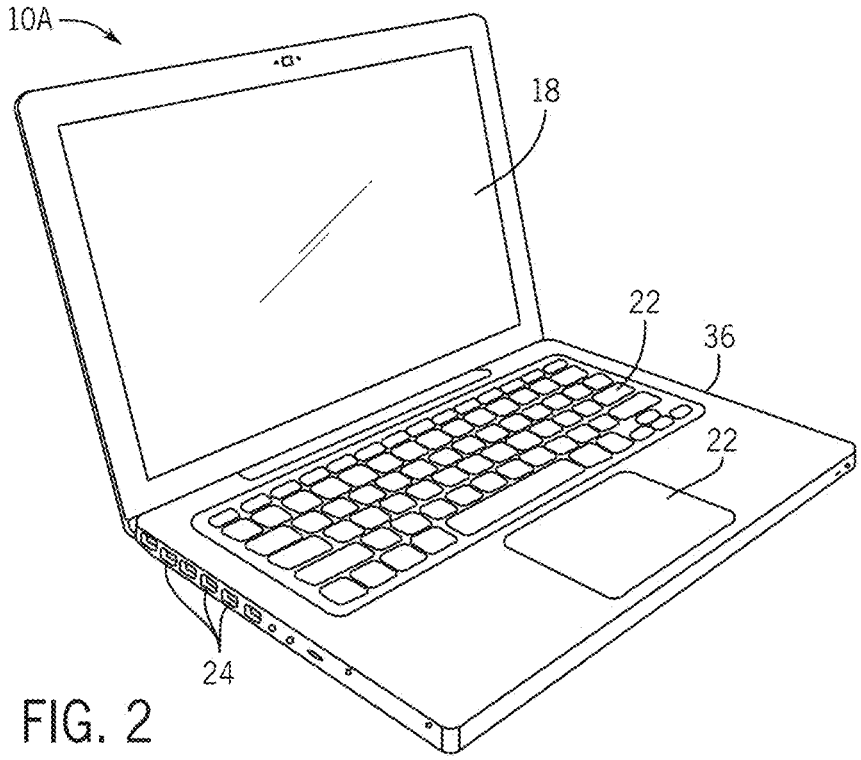
FIG. 2 is a perspective view of a notebook computer representing an embodiment of the electronic device of FIG. 1.
Figure 4:
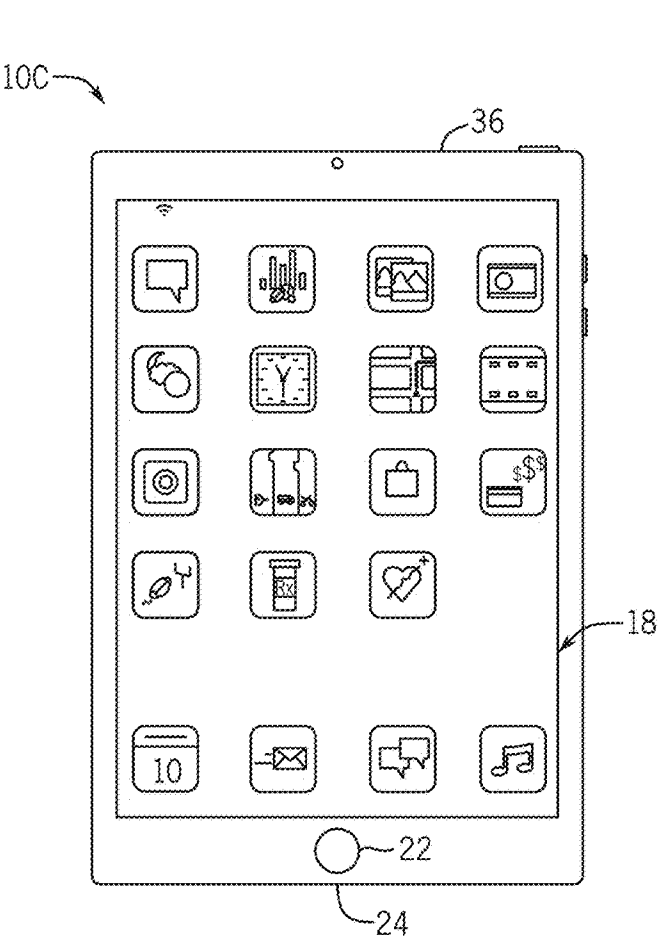
FIG. 4 is a front view of another hand-held device representing another embodiment of the electronic device of FIG. 1.
Figure 3:
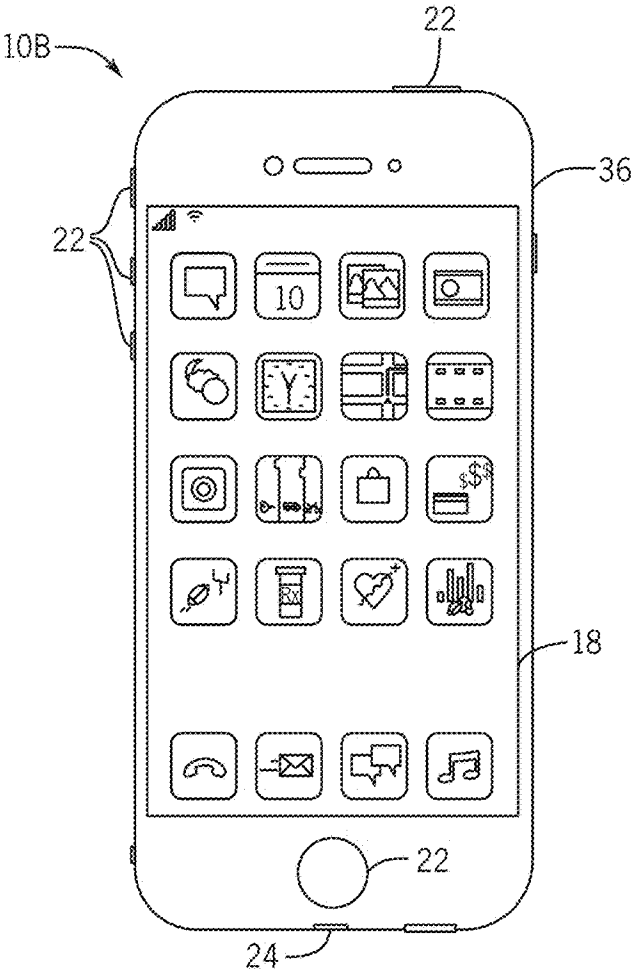
FIG. 3 is a front view of a hand-held device representing another embodiment of the electronic device of FIG. 1.
Figure 5:
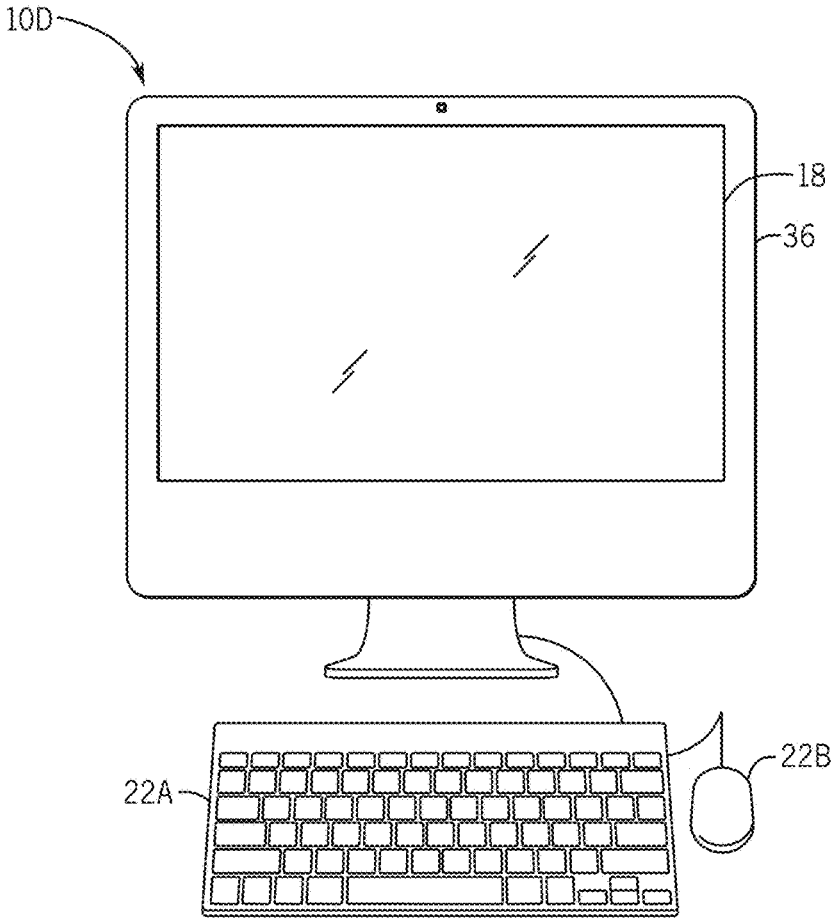
FIG. 5 is a front view of a desktop computer representing another embodiment of the electronic device of FIG. 1.
Figure 6:
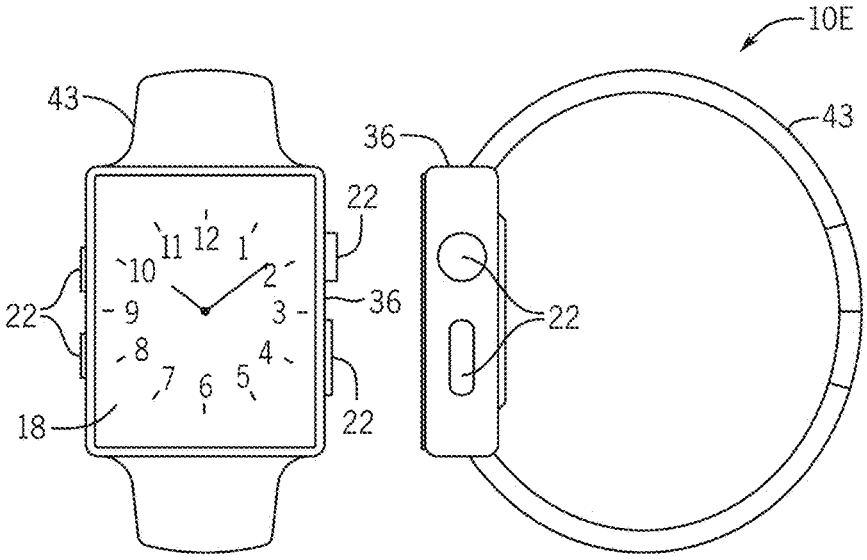
FIG. 6 is a front view and side view of a wearable electronic device representing another embodiment of the electronic device of FIG. 1.

With this in mind, a block diagram of an electronic device 10 is shown in FIG. 1 that may perform differential sensing (DS), difference-differential sensing (DDS), correlated double sampling (CDS), and/or may employ programmable capacitor matching to reduce display panel sensing noise. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
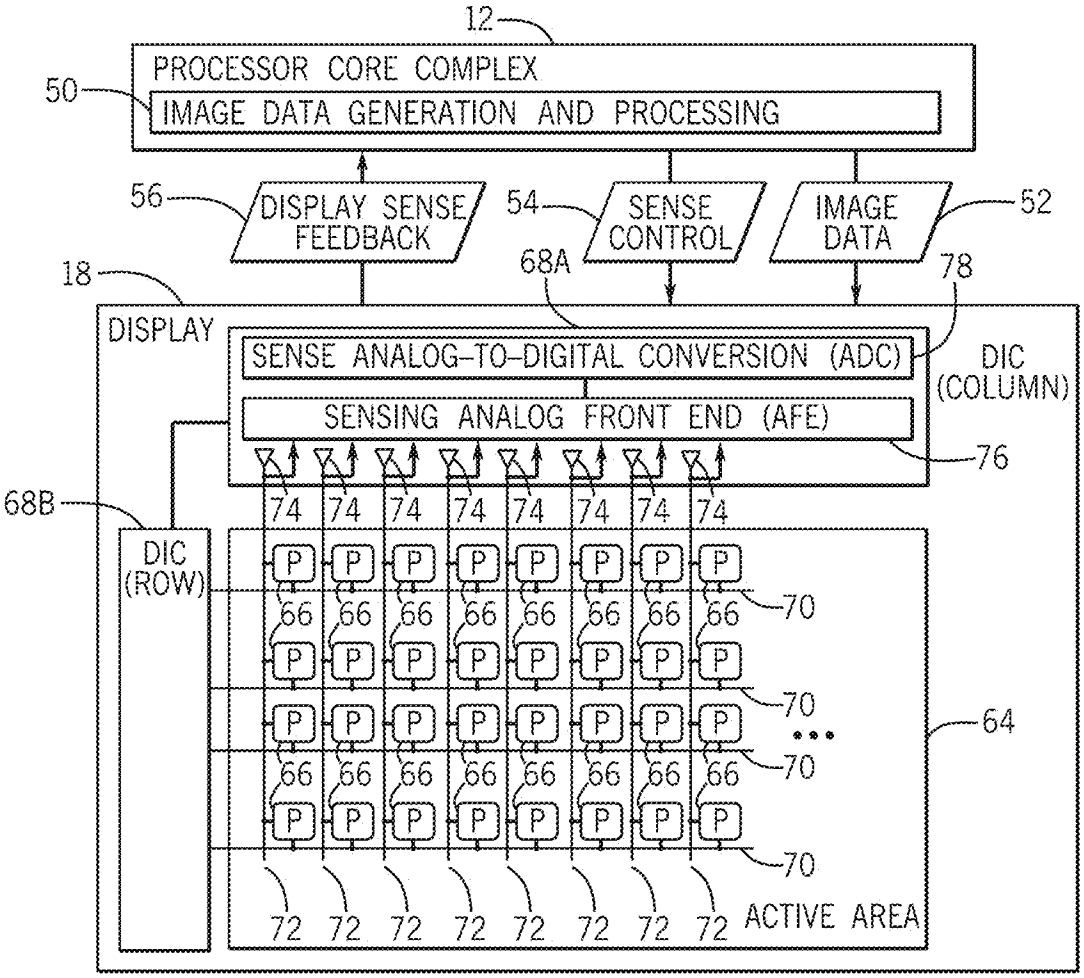
FIG. 7 is a block diagram of an electronic display that performs display panel sensing, in accordance with an embodiment.

As shown in FIG. 7, in the various embodiments of the electronic device 10, the processor core complex 12 may perform image data generation and processing 50 to generate image data 52 for display by the electronic display 18. The image data generation and processing 50 of the processor core complex 12 is meant to represent the various circuitry and processing that may be employed by the core processor 12 to generate the image data 52 and control the electronic display 18. Since this may include compensating the image data 52 based on operational variations of the electronic display 18, the processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing 50 into a compensation value that, when applied to the image data 52, appropriately compensates the image data 52 for the conditions of the electronic display 18. This results in greater fidelity of the image data 52, reducing or eliminating visual artifacts that would otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit 68, which may be a single module or may be made up of separate modules, such as a column driver integrated circuit 68A and a row driver integrated circuit 68B. The driver integrated circuit 68 (e.g., 68B) may send signals across gate lines 70 to cause a row of pixels 66 to become activated and programmable, at which point the driver integrated circuit 68 (e.g., 68A) may transmit image data signals across data lines 72 to program the pixels 66 to display a particular gray level (e.g., individual pixel brightness). By supplying different pixels 66 of different colors with image data to display different gray levels, full-color images may be programmed into the pixels 66. The image data may be driven to an active row of pixel 66 via source drivers 74, which are also sometimes referred to as column drivers.

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area of 64 of the electronic display 18, such as variations and temperature of the active area 64, as well as the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18.

Display panel sensing may be used to obtain the display sense feedback 56, which may enable the processor core complex 12 to generate compensated image data 52 to negate the effects of temperature, aging, and other variations of the active area 64. The driver integrated circuit 68 (e.g., 68A) may include a sensing analog front end (AFE) 76 to perform analog sensing of the response of pixels 66 to test data. The analog signal may be digitized by sensing analog-to-digital conversion circuitry (ADC) 78.

For example, to perform display panel sensing, the electronic display 18 may program one of the pixels 66 with test data. The sensing analog front end 76 then senses a sense line 80 of connected to the pixel 66 that is being tested. Here, the data lines 72 are shown to act as the sense lines 80 of the electronic display 18. In other embodiments, however, the display active area 64 may include other dedicated sense lines 80 or other lines of the display may be used as sense lines 80 instead of the data lines 72. Other pixels 66 that have not been programmed with test data may be sensed at the same time a pixel that has been programmed with test data. Indeed, by sensing a reference signal on a sense line 80 when a pixel on that sense line 80 has not been programmed with test data, a common-mode noise reference value may be obtained. This reference signal can be removed from the signal from the test pixel that has been programmed with test data to reduce or eliminate common mode noise.

The analog signal may be digitized by the sensing analog-to-digital conversion circuitry 78. The sensing analog front end 76 and the sensing analog-to-digital conversion circuitry 78 may operate, in effect, as a single unit. The driver integrated circuit 68 (e.g., 68A) may also perform additional digital operations to generate the display feedback 56, such as digital filtering, adding, or subtracting, to generate the display feedback 56, or such processing may be performed by the processor core complex 12.

Figure 8:
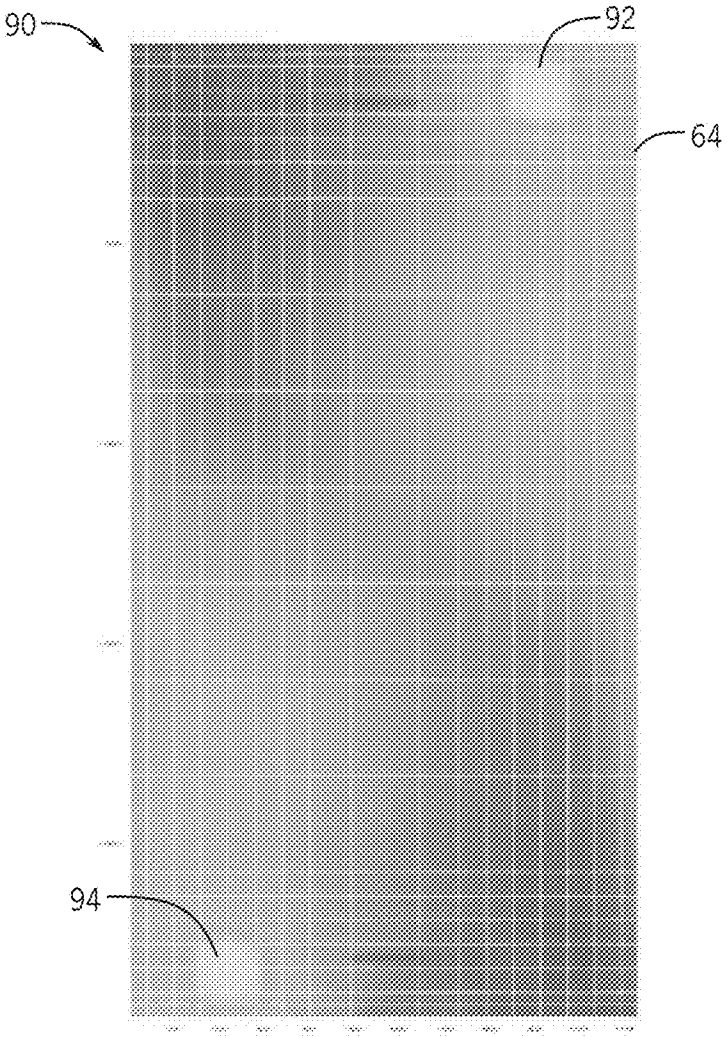
FIG. 8 is a thermal diagram indicating temperature variations due to heat sources on the electronic display, in accordance with an embodiment.

A variety of sources can produce heat that could cause a visual artifact to appear on the electronic display 18 if the image data 52 is not compensated for the thermal variations on the electronic display 18. For example, as shown in a thermal diagram 90 of FIG. 8, the active area 64 of the electronic display 18 may be influenced by a number of different nearby heat sources. For example, the thermal map 90 for FIG. 8 illustrates the effect of two heat sources that create high local distributions of heat 92 and 94 on the active area 64. These heat sources 92 and 94 may be any heat-producing electronic component, such as the processor core complex 12, camera circuitry, or the like, that generate heat in a predictable pattern on the electronic display 18.

Figure 9:
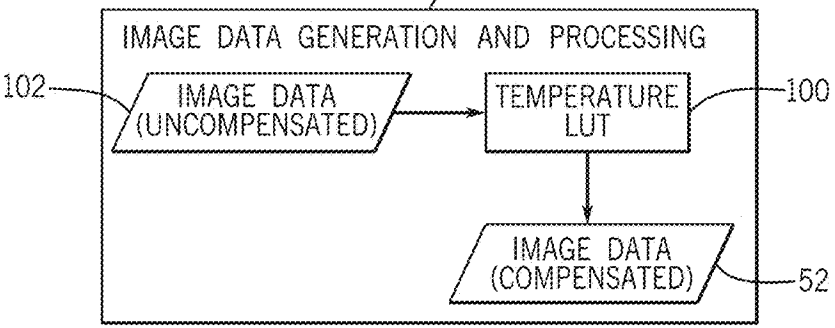
FIG. 9 is a block diagram of a process for compensating image data to account for changes in temperature on the electronic display, in accordance with an embodiment.

As shown in FIG. 9, the effects of the heat variation caused by the heat sources 92 and 94 may be corrected using the image data generation and processing system 50 of the processor core complex 12. For example, uncompensated image data 102 may be indexed to a temperature lookup table 100, which contains a correction factor to apply to each pixel 66 of the electronic display 18 that would prevent visual artifacts due to thermal variations on the active area 64 of the electronic display 18. Thus, the temperature lookup table (LUT) 100 may operate as a correction LUT (e.g., a two-dimensional lookup table) is used to obtain compensated image data 52. Although not shown in particular in FIG. 9, it should be appreciated that the temperature lookup table (LUT) 100 may represent a table of coefficient values to apply to the uncompensated image data 102. The compensated image data 52 may be obtained when the coefficient values from the temperature lookup table (LUT) 100 are applied to the uncompensated image data 102.

Figure 10:
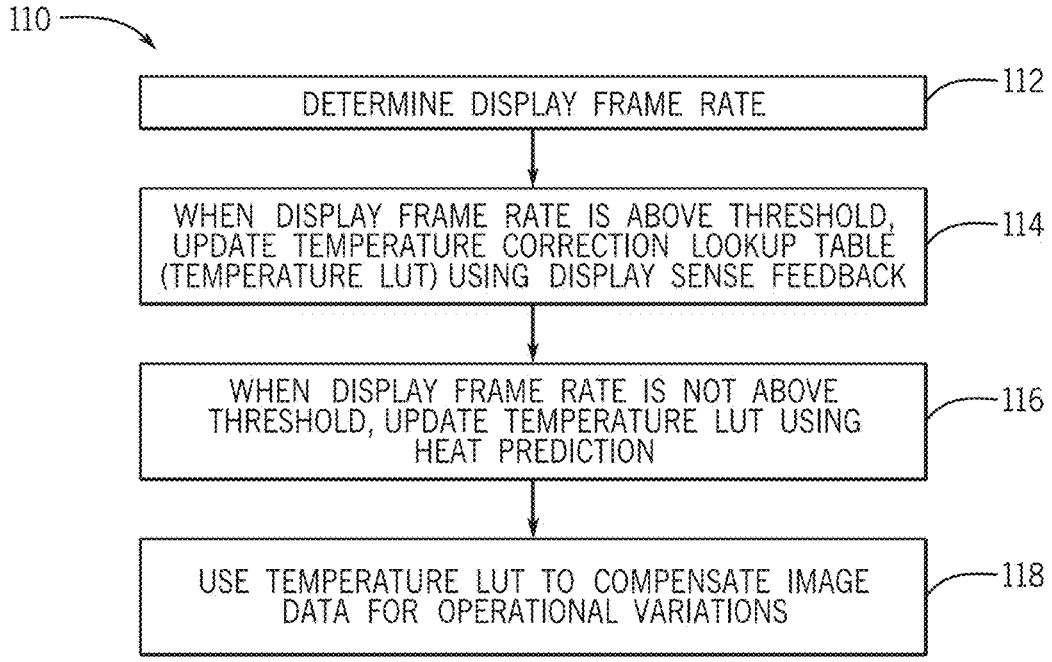
FIG. 10 is a flowchart of a method for determining to perform predictive temperature correction based at least in part on a display frame rate on the electronic display, in accordance with an embodiment.

Because the amount of heating on the active area 64 of the electronic display 18 may change faster than could be updated using display panel sensing to update the temperature lookup table (LUT) 100, in some embodiments, predictive compensation may be performed based on the current frame rate of the electronic display 18. However, it should be understood that, in other embodiments, predictive compensation may be performed at all times or when activated by the processor core complex 12. An example of determining to perform predictive compensation based on the current frame rate of the electronic display 18 is shown by a flowchart 110 of FIG. 10. In the flowchart 110, the processor core complex 12 may determine the current display frame rate on the electronic display 18 (block 112). When the display frame rate is above some threshold frame rate indicating that the temperature lookup table (LUT) 100 could be updated quickly enough using display panel sensing alone, the processor core complex 12 may update the temperature correction lookup table (LUT) 100 using the display sense feedback (block 114). When the display frame rate is not above the threshold, the processor core complex 12 may update the temperature lookup table (LUT) 100 at least in part using heat predication on the electronic display due to heat sources (e.g., heat sources 92 and 94) or changes in content (block 116). In either case, the processor core complex 12 may use the temperature lookup table (LUT) 100 to obtain compensated image data 52 to account for operational variations of the electronic display 18 caused by heat variations across the electronic display 18.

Figure 11:
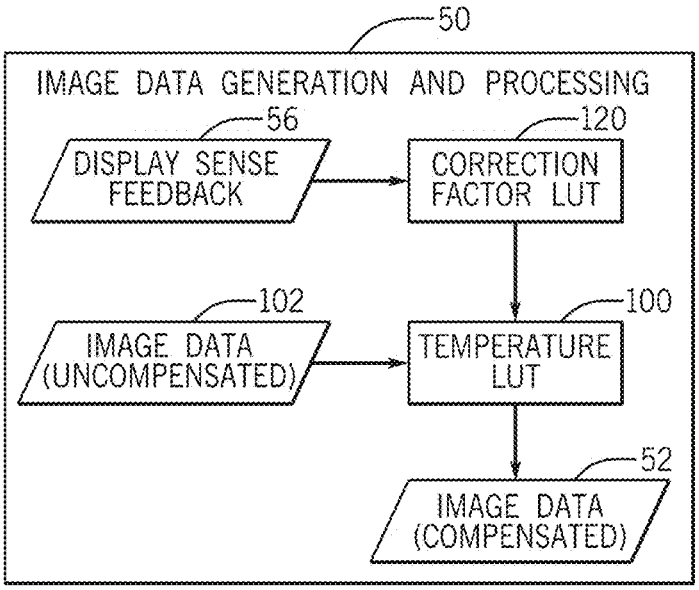
FIG. 11 is a block diagram of circuitry to compensate image data for thermal variations of the electronic display using display sense feedback, in accordance with an embodiment.

FIG. 11 illustrates a system for updating the temperature lookup table (LUT) 100 based on display sense feedback 56 or in the image data generation processing system 50 of the processor core complex 12. In the example of FIG. 11, display sense feedback 56 from the electronic display 18 may be provided to a correction factor lookup table 120 that may transform the values of the display based feedback 56 into corresponding values representing a correction factor that, when applied to the uncompensated image data 102, would result in the compensated image data 32. The display sense feedback 56 may represent display panel sensing from various locations in the active area 64 of the electronic display. When the refresh rate is high enough, the display sense feedback is able to cover enough of the spatial locations on the active area 64 of the electronic display 18 to enable the temperature lookup table (LUT) 100 to be accurate.

Figure 12:
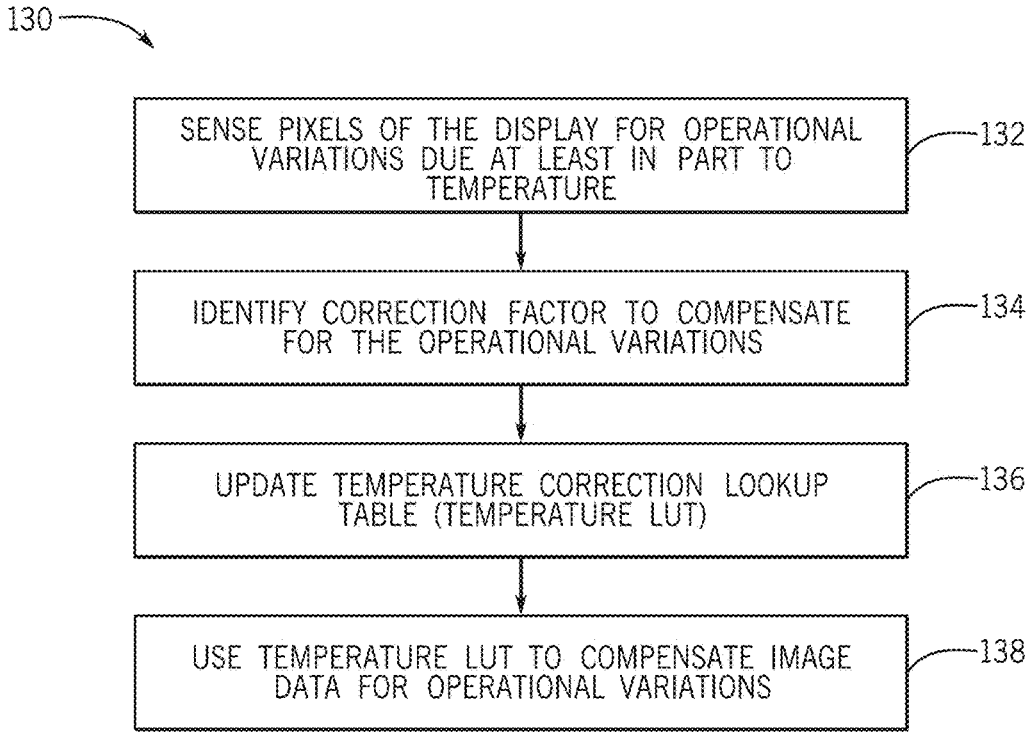
FIG. 12 is a flowchart of a method for compensating the image data for the temperature variations of the electronic display, in accordance with an embodiment.

Indeed, as shown in a flowchart 130 of FIG. 12, the electronic display may sense pixels 166 of the active area 64 of the display to obtain indications of operational variations due at least in part to temperature (block 132), which is shown in FIG. 11 as the display sense feedback 56. The display sense feedback 56 may be converted to an appropriate correction factor that would compensate for the operational variations (block 134). These correction factors may be used to update the temperature lookup table (LUT) 100 (block 136). Thereafter, the temperature lookup table (LUT) 100 may be used to compensate the uncompensated image data 102 to obtain the compensated image data 52 (block 138).

Heat-Source-Based Temperature Prediction

Figure 13:
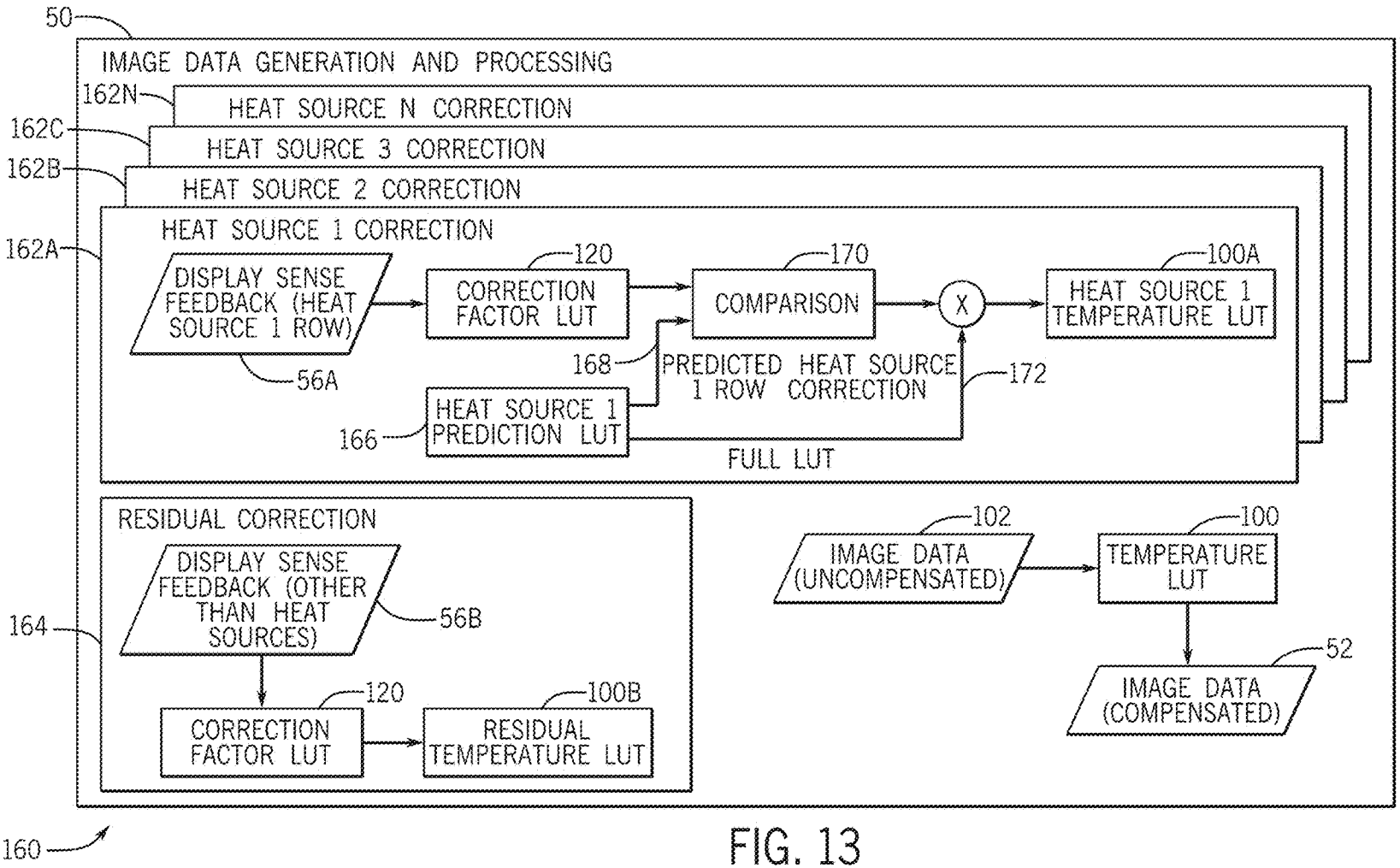
FIG. 13 is a block diagram of a system to perform predictive temperature correction, in accordance with an embodiment.

A predictive heat correction system 160 is shown in a block diagram of FIG. 13. The predictive heat correction system 160 may be carried out using any suitable circuitry and/or processing components. In one example, the predictive heat correction system 160 is carried out within image data and image data generation and processing system 50 of the processor core complex 12. The predictive heating correction system 160 may include heat source correction loops 162 for any suitable number of independent heat sources that may be present near the electronic display 18. Here, there are N heat sources that are being corrected for, so there are N heat source correction loops 162: a first heat source correction loop 162A, second heat source correction loop 162B, third heat source correction loop 162C, and Nth heat source correction loop 162N. Each of the heat source correction loops 162 may be used to update the temperature lookup table (LUT) 100 to correct for thermal or aging variations on the active area 64 on the electronic display 18. There may be some amount of residual correction from parts of the active area 64 other than where the heat sources are located that may be adjusted through a residual correction loop 164.

Each heat source correction loop 162 may have an operation that is similar to the first heat source correction loop 162A, but which relates to a different heat source. That is, each heat source loop 162 can be used to correct for visual artifacts that can be used to update the temperature lookup table (LUT) 100 to correct for artifacts due to that particular heat source (but not other heat sources). Thus, referring particularly to the first heat source correction loop 162A, a first heat source prediction lookup table (LUT) 166 may be used to update the temperature lookup table (LUT) 100 for a particular reference value of the amount of heat being emitted by the first heat source (e.g., heat source 92). Yet because the amount of heat emitted by the first heat source to account for the variations in the amount of heat that could be emitted by the first heat source (e.g., heat source 92), the first heat source prediction lookup table (LUT) 166 can be scaled up or down depending how closely the first heat source prediction lookup table (LUT) 166 matches current conditions on the active area 64.

The first heat source correction loop 162A may receive a reduced form of display sense feedback 56A at least from pixels that are located on the active area 64 where the first heat source will most prominently affect the active area 64. The display sense feedback 56A may be an average, for example of multiple pixels 66 that have been sensed on the active area 64. In the particular example shown in FIG. 13, the display sense feedback 56A is an average of a row of pixels 66 that is most greatly affected by the first heat source. The display sense feedback 56A may be converted to a correction factor by the correction factor LUT 120. Meanwhile, a first heat source prediction lookup table 166 may provide a predicted first heat source correction value 168 from the same row as the display sense feedback 56A, which may be compared to the display sense feedback 56A in comparison logic 170. The first heat source prediction LUT 166 may contain a table of correction factors that would enable the uncompensated image data 102 to be converted to compensated image data 52 when the heat from the first heat source (e.g., heat source 92) is at a particular level. In one example, the first heat source prediction LUT 166 may contain a table of correction factors for a maximum amount of heat or maximum temperature due to the first heat source.

Since the amount of correction that may be used to correct from the first heat source may scale with this amount of heat, the values of the first heat source prediction LUT 166 may be scaled based on the comparison of the values from the display sense feedback 56A and the predicted first heat source correction value 168 from the same row as the display sense feedback 56A. This comparison may identify a relationship between the predicted heat source row correction values (predicted first heat source correction value 168) and the measured first heat source row correction values (display sense feedback 56A) to obtain a scaling factor "a". The entire set of values of the first heat source prediction lookup table 166 may be scaled by the scaling factor "a" and applied to a first heat source temperature lookup table (LUT) 100A. Each of the other heat source correction loops 162B, 162C, . . . 162N may similarly populate a respective heat source temperature lookup tables (not shown) similar to the first heat source temperature lookup table (LUT) 100A, which may be added together into the overall temperature lookup table (LUT) 100 that is used to compensate the image data 102 to obtain the compensated image data 52.

Additional corrections may be made using the residual correction loop 164. The residual correction loop 164 may receive other display sense feedback 56B that may be from a location on the active area 64 of the electronic display 18 other than one that is most greatly affected by one of the heat sources 1, 2, 3, . . . N. The display sense feedback 56B may be converted to appropriate correction factor(s) using the correction factor LUT 120 and these correction factors may be used to populate a temperature lookup table (LUT) 100B, which may also be added to the overall temperature lookup table (LUT) 100.

Figure 14:
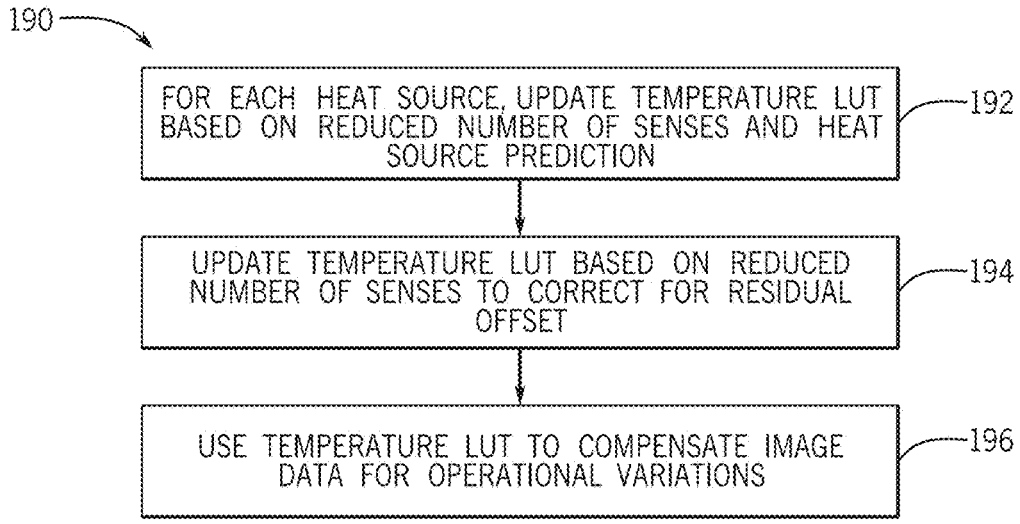
FIG. 14 is a flowchart of a method to perform the predictive temperature adjustment, in accordance with an embodiment.

To summarize, as shown by a flowchart 190 of FIG. 14, the temperature lookup table (LUT) 100 may be updated to account for each heat source based on a reduced number of display panel senses and the heat source prediction associated with that heat source (block 192). A residual offset may also be used to update the temperature lookup table (LUT) 100 using a number of senses obtained from a part of the active area 64 of the electronic display 18 that is not most greatly affected by any of the heat sources (block 194). The updated temperature lookup table (LUT) 100 may be used to compensate image data 102 to obtain compensated image data 52 that is compensated for operational variations that is due to the heat sources affecting the electronic display 18 (block 196).

Content-Dependent Temperature Prediction

Figure 15:
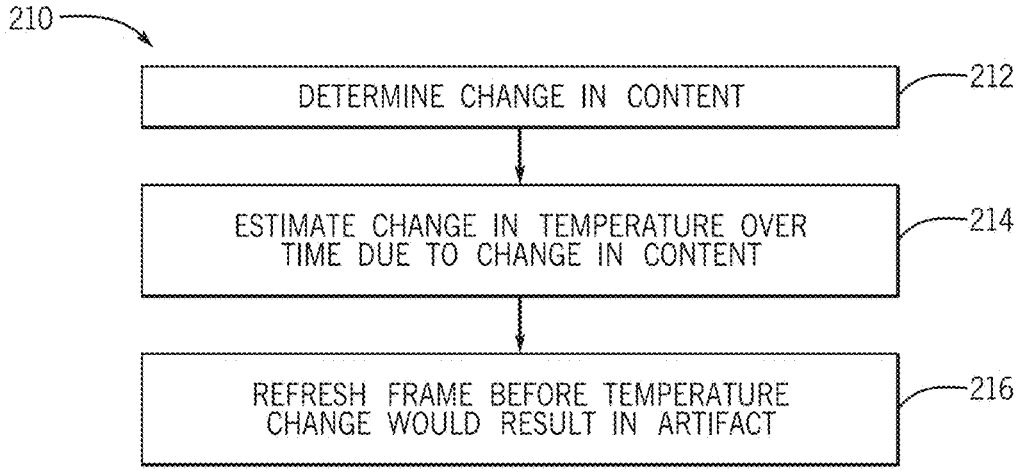
FIG. 15 is a flowchart of a method for controlling an electronic display due at least in part to a predicted temperature change due to a change in image data content, in accordance with an embodiment.

A temperature prediction based on the change in content on the electronic display may also be used to prevent visual artifacts from appearing on the electronic display 18. For instance, as shown by a flowchart 210 of FIG. 15, a change in the brightness of content in the image data 52 to be displayed on the electronic display may be determined when one frame changes to another frame (block 212). An estimated change in temperature over time caused by the change in brightness of the content may be estimated (block 214). Based on the estimated change in temperature over time, the electronic display 18 may be refreshed earlier than otherwise. Namely, when the change in temperature over time would be expected to cause a visual artifact to appear due to the change in temperature on the electronic display 18, the electronic display 18 may be refreshed (block 216). It should be appreciated that this technique, while described in relation to change in content, may additionally or alternatively take into account the changes in other heat sources, such as the heat-producing components discussed above.

Figure 16:
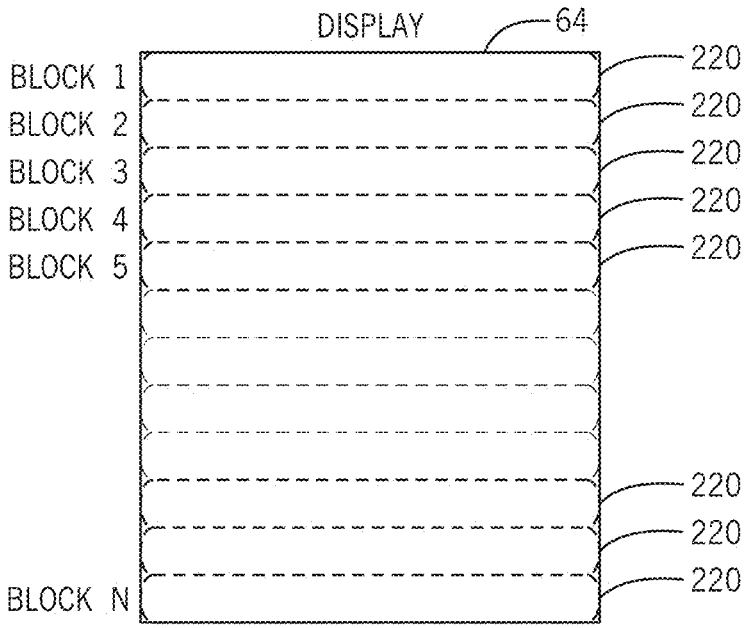
FIG. 16 is a diagram showing blocks of image data to be displayed on the electronic display for analysis of thermal changes due changes in the image data, in accordance with an embodiment.

Identifying a change in content may involve identifying a change in content within in a particular block 220 of content on the display of active area 64, as shown in FIG. 16. The blocks 220 shown in FIG. 16 are meant to provide only one example of blocks of content that may be analyzed. The blocks 220 may be as small as a single pixel or as large as the entire display panel 64. However, by segmenting the pixel 66 into multiple blocks 220 that each encompasses a subset of the total number of pixels 66 of the active area 64, efficiencies may be gained. Indeed, this may reduce the amount of computing power involved in computing brightness change that would be used in calculating this for every single pixel 66, while providing a more discrete portion of the total pixels of the active area 64 than the entire active area.

The size of the blocks 220 may be fixed at a particular size and location or may be adaptive. For example, the size of the blocks that are analyzed for changes in content may vary depending on a particular frame rate. Namely, since a slower frame rate could produce a greater amount of local heating, blocks 220 may be smaller for slower frame rates and larger for faster frame rates. In another example, the blocks may be larger for slower frame rates to computing power. Moreover, the blocks 220 may be the same size throughout the electronic display 18 or may have different sizes. For example, blocks 220 from areas of the electronic display 18 that may be more susceptible to thermal variations may be smaller, while blocks 220 from areas of the electronic display 18 that may be less susceptible to thermal variations may be larger.

Figure 17:
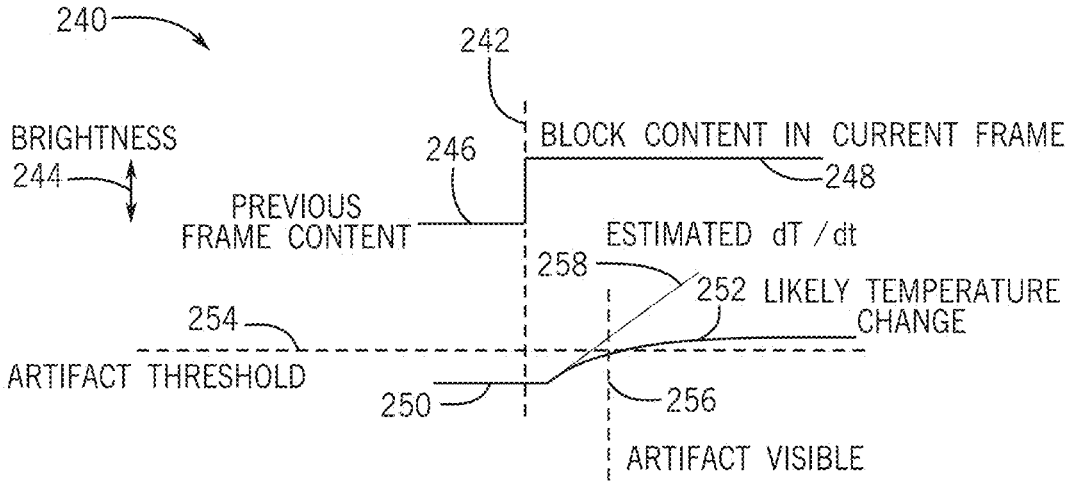
FIG. 17 is a timing diagram showing a change in content between two frames and an estimated change in temperature that occurs as a result, in accordance with an embodiment.

As shown by a timing diagram 240, the content of a particular block 220 may vary upon a frame refresh 242, at which point content changes from that provided in a previous frame 246 to that provided in a current frame 248. When the current frame 248 begins to be displayed, a particular block 220 may have a change in the brightness from the previous frame 246 to the current frame 248. In the example of FIG. 17, the previous frame content 246 is less bright than the current frame 248. This means that the current frame 248 causes the pixel 66 to emit more light, and therefore, when the pixel 66 is part of a self-emissive display such as an OLED display, this causes the pixel 66 to emit a greater amount of heat as well. This increase in heat will cause the temperature on the active area 64 of the display to increase. While the example of FIG. 17 shows an increase in brightness, leading to an increase of heat output and an increase in temperature on the active area 64, in other cases, the previous frame content 246 may have brighter than the current frame 248. When the content changes from brighter to less bright, this may cause the amount of heat to be emitted to be lower, and therefore to cause the temperature in that part of the active area 64 to decrease instead.

Thus, as the content between the previous frame 246 and the current frame 248 has changed, the temperature also changes. If the temperature changes too quickly, even though the image data 52 may have been compensated for a correct temperature at the point of starting to display the current frame 248, the temperature may cause the appearance of the current frame 248 to have a visual artifact. Indeed, the temperature may change fast enough that the amount of compensation for the current frame 248 may be inadequate. This situation is most likely to occur when the refresh rate of the electronic display 18 is slower, such as during a period of reduced refresh rate to save power.

A baseline temperature 250 thus may be determined and predicted temperature changes accumulated based on the baseline temperature 250. The baseline temperature 250 may correspond to a temperature understood to be present at the time when the previous frame 246 finishes being displayed and the current frame 248 begins. In some cases, the baseline temperature 250 may be determined from an average of additional previous frames in addition to the most recent previous frame 246. Other functions than average may also be used (e.g., a weighted average of previous frames that weights the most recent frames more highly) to estimate the baseline temperature 250. From the baseline 250, a curve 252 is shown a likely temperature change as the content increases in brightness between the previous frame 246 and the current frame 248. There may be an artifact threshold 254 representing a threshold amount of temperature change, beyond which point a visual artifact may become visible at a time 256. To avoid having a visual artifact appear due to temperature change, at the time 256, a change in temperature over time (dT/dt) 258 may be identified. A new, early frame may be provided when the estimated rate of change in temperature (dT/dt) 258 crosses the artifact threshold 254.

Figure 18:
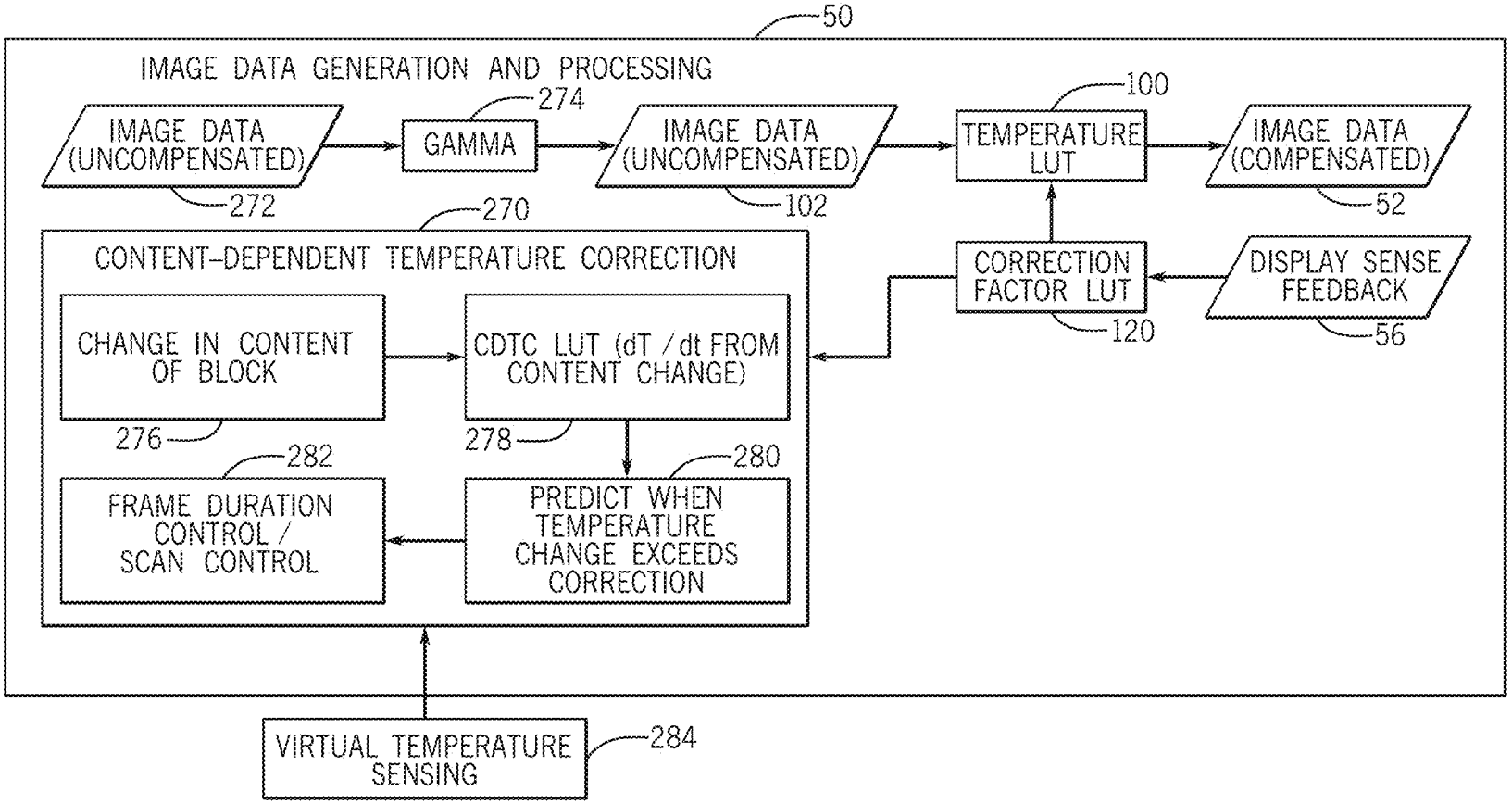
FIG. 18 is a block diagram of a system for performing content-dependent temperature correction, in accordance with an embodiment.

One example of a system for operating the electronic display 18 to avoid visual artifacts due to temperature changes based on content appears in a block diagram of FIG. 18. The block diagram of FIG. 18 may include a content-dependent temperature correction loop 270 that may operate based at least partly on changes in content in the image data that is to be displayed on the electronic display 18. In the example shown in FIG. 18, uncompensated image data 272 in a linear domain is used, but the uncompensated image data 102 or the compensated image data 52, both of which may be in the gamma domain for display on the electronic display 18, may be used instead. To generate the uncompensated image data 102 from the uncompensated image data 272 in the linear domain, a gamma transformation 274 may be performed.

The content-dependent temperature correction loop 270 may include circuitry or logic to determine changes in the content of various blocks 220 of content in the image data 272 (block 276). A content-dependent temperature correction lookup table (CDCT LUT) 278 may obtain a rate of temperature change estimated based on a previous content of a previous frame or an average of previous frames and the current frame of image data 272. An example of the content-dependent temperature correction lookup table (CDCT LUT) 278 will be discussed further below with reference to FIG. 19. The estimated rate of temperature change (dT/dt) due to the change in content may be provided to circuitry or logic that keeps a running total of temperature change over time for each block of content. This running total may be used to predict when the change in temperature will result in a total amount of temperature change that exceeds the ability of the current temperature lookup table (LUT) 100 to compensate the uncompensated image data 102 (block 280). Frame duration control and sense scan control circuitry or logic 282 may cause the electronic display 18 to receive a new frame, performing display sense feedback 56 on at least on a subset of the active area 64 that includes the block exceeding the artifact threshold. The display sense feedback 56 therefore may be provided to the correction factor LUT 120 to update the temperature lookup table (LUT) 100 at least for the block that is predicted to have changed enough in temperature to otherwise cause an artifact if it had not otherwise been refreshed. Thus, when the uncompensated image data 102 of the frame is compensated using the temperature lookup table (LUT) 100, the uncompensated image data 52 may take into account the current temperature on the display as measured by the display sense feedback 56.

When a new frame is caused to be sent to the electronic display 18 and the display sense feedback 56 for the block that triggered the new frame is obtained, the correction factor associated with that block may be provided to the content-dependent temperature correction loop 270. This may act as a new baseline temperature for predicting a new accumulation of temperature changes in block 280. In addition, virtual temperature sensing 284 (e.g., as provided by other components of the electronic device 10, such as an operating system running on processor core complex 12, or actual temperature sensors disposed throughout the electronic device 10) may also be used by the content-dependent temperature correction loop 270 to predict a temperature change accumulation at block 280 to trigger provision of new image frames and new display sense feedback 56 from the frame duration control/frame control circuitry or logic block 282.

Figure 19:
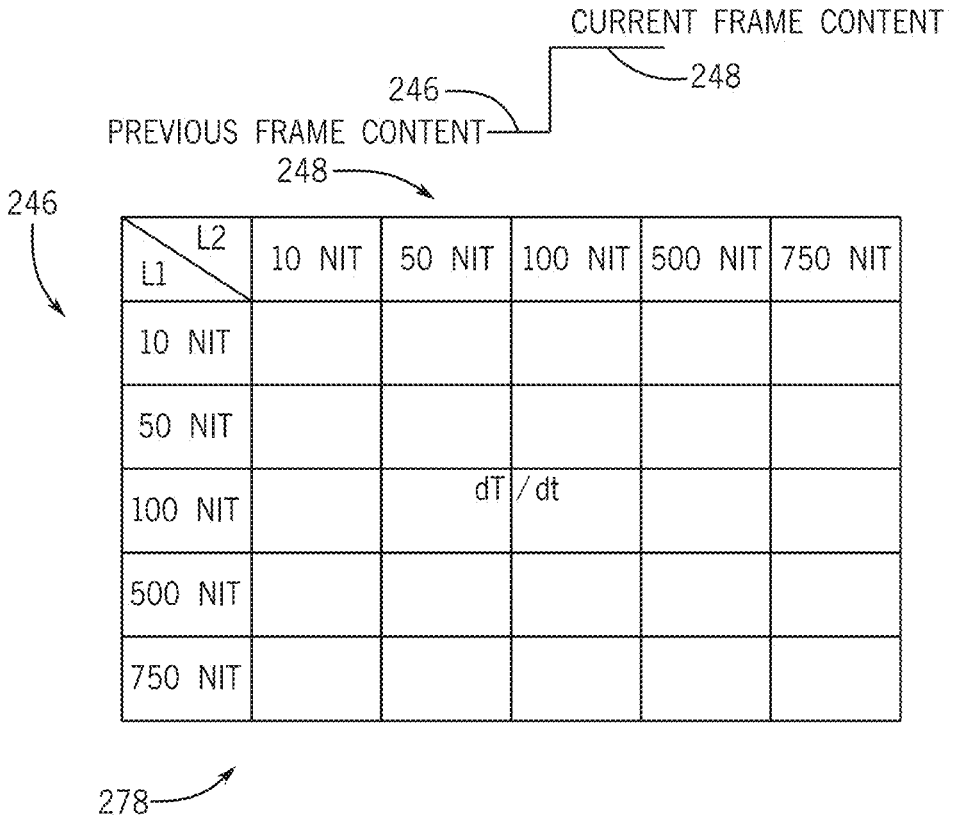
FIG. 19 is a table to estimate a change in temperature over time based on a change in brightness between content of two image frames, in accordance with an embodiment.

FIG. 19 is a block diagram representing the content-dependent temperature control lookup table (CDCT LUT) 278. The content-dependent temperature correction LUT 278 may be a two-dimensional table with indices representing the brightness of previous frame 246 and the brightness of a current frame 248. The particular amount of temperature change dT/dt may be obtained experimentally and/or through modeling of the electronic display 18. In some embodiments, there may be multiple content-dependent temperature control lookup tables (CDCT LUTs) 278, each corresponding to a different mode of operation and/or block location. For example, there may be a content-dependent temperature control lookup table (CDCT LUT) 278 for indoor lighting circumstances and there may be another content-dependent temperature control lookup table (CDCT LUT) 278 for outdoor lighting circumstances when the sun is likely to also heat the electronic display 18. Additionally or alternatively, there may be a content-dependent temperature control lookup table (CDCT LUT) 278 for certain blocks of pixels and another content-dependent temperature control lookup table (CDCT LUT) 278 for other blocks of pixels.

Figure 20:
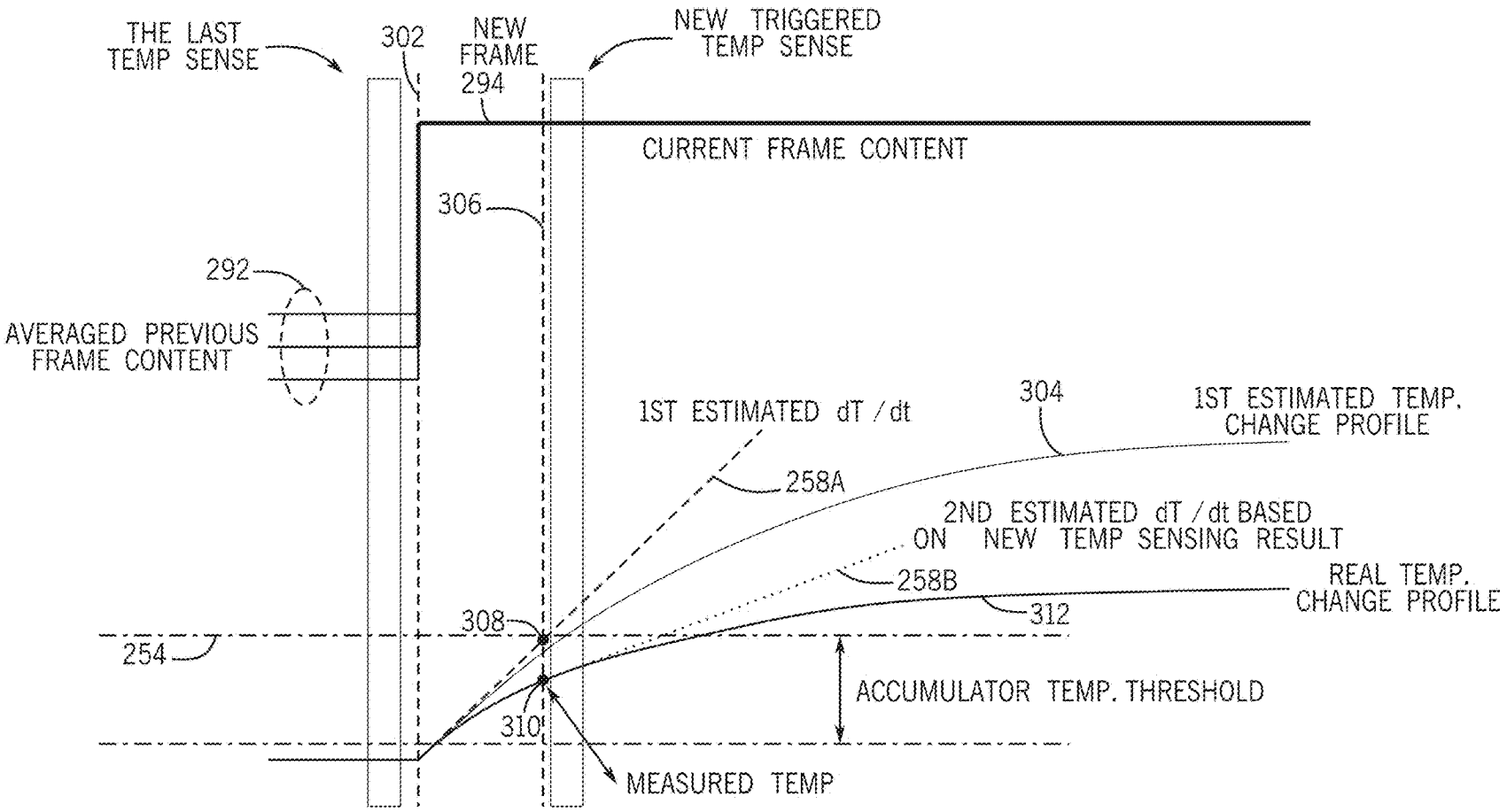
FIG. 20 is a timing diagram of predicted changes in temperature on an electronic display due to changes in content to be displayed on the electronic display, in accordance with an embodiment.

Another example of performing the content-dependent temperature correction for a particular block of content is described by a timing diagram 290 of FIG. 20. As shown in the timing diagram 290, an average brightness of a block of content from a previous frame 292 may be compared to a new brightness of the block of content from a current frame 294. Upon receipt of a refresh 302 where the content changes, an initial estimated rate of temperature change 258A may be determined and compared to the artifact threshold 254. Note that the true likely temperature change over time 304 may be represented a function over time in which the estimated rate of temperature change (dT/dt) 258A is asymptotic, approaching some maximum temperature change, for ease of computation, a new frame 306 may be triggered when the first estimated rate of temperature change 258A is detected to cross the artifact threshold 254 at a point 308. This may cause new display panel sensing 56 at least at a location corresponding to a block of content that is described in the timing diagram 290 of FIG. 20. The new display panel sensing 56 (e.g., as shown in FIG. 18) may be used to establish a new baseline temperature 310 for the block of content at the point where the new frame 306 is written to the electronic display 18. It should be understood that the new frame 306 may include the same content as the current frame 294, except that the block of content that is described in the timing diagram 290 of FIG. 20 may have been updated to be compensated for the newly determined baseline temperature 310. In other embodiments, the block of content that is described in the timing diagram 290 of FIG. 20 may not have been updated, but rather a new estimated rate of temperature change (dT/dt) 258B may be determined and monitored to determine when this would cross the artifact threshold 254. As noted above, the new estimated rate of temperature change (dT/dt) 258B may be used for ease of calculation instead of a true likely temperature change 312, which would likely cross the artifact threshold 254 at a later time.

Figure 21:
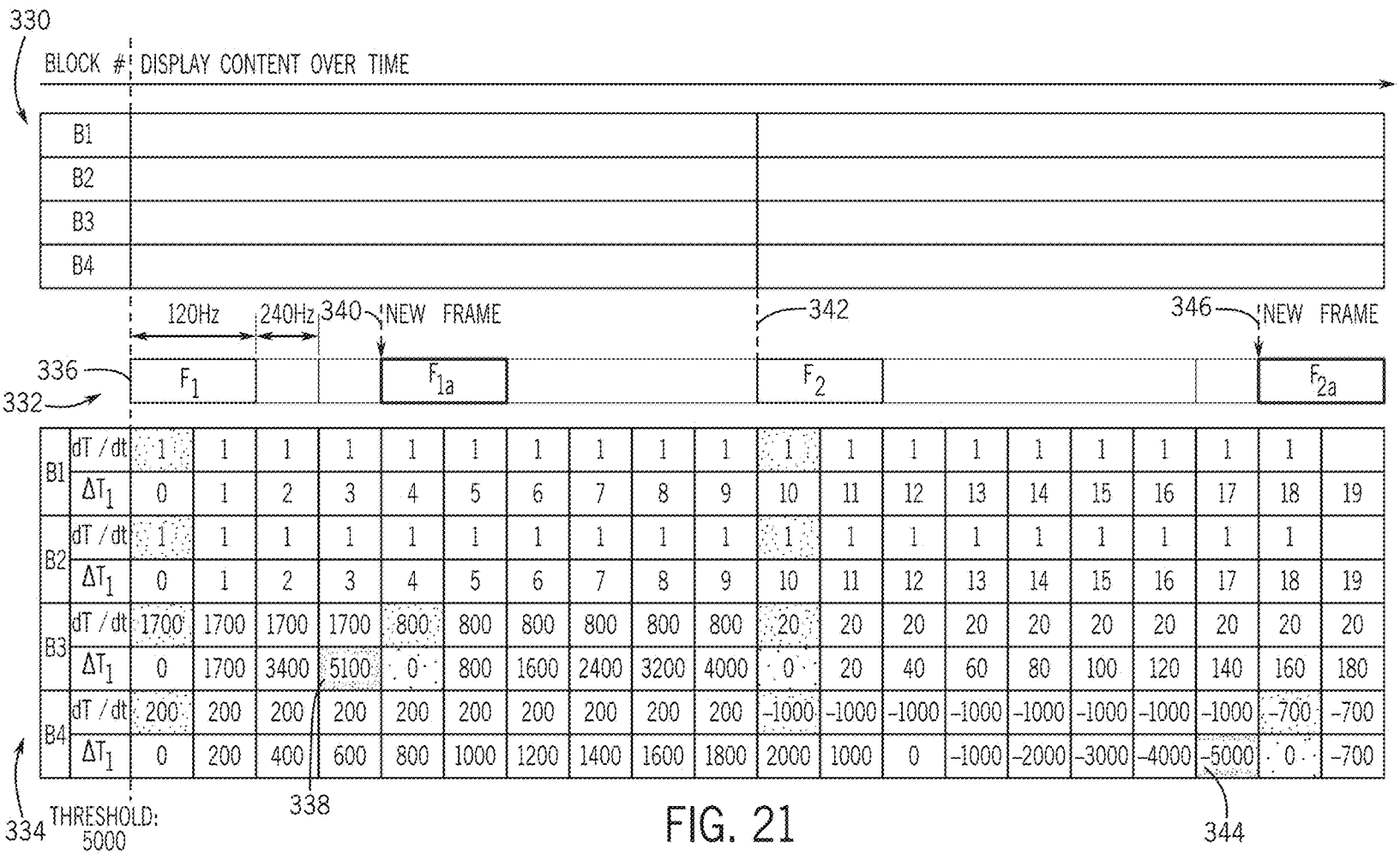
FIG. 21 is a timing diagram that illustrates accumulating a predicted amount of temperature change over time to trigger a new frame to prevent the appearance of a visional artifact due to the predicted temperature change, in accordance with an embodiment.

FIG. 21 provides another example of content-dependent temperature prediction by accumulating the rate of temperature change over discrete points in time. FIG. 21 may represent an example of the block 280 of FIG. 18. Namely, FIG. 21 shows accumulation values over time for various blocks B1, B2, B3, and B4 of content appearing on the electronic display 18. The content is shown generally by in visual form at numeral 330, timing of writing new frames is shown at numeral 232, and calculated temperature accumulation is shown at numeral 334. In the example of FIG. 21, the change in temperature in relation to time is shown to be in units of temperature in which 5000 units of temperature accumulation produces a visual artifact, and time is measured per 240 Hz accumulation cycle, but any suitable accumulation calculation rate may be used, which may be larger or smaller than 240 Hz. Moreover, while the 5000 units of temperature accumulation is used as a magnitude threshold that can be either positive or negative in this example, this threshold may vary for different situations. For example, the threshold may vary depending on whether the change is positive or negative, and may depend on the starting temperature of a block of content.

Display block content is shown to begin upon writing a new frame 336. In the example of FIG. 21, the change in content of blocks B1 and B2 is relatively minor, prompting a change in estimated temperature change to be relatively small (here, a value of 1 unit, where a visual artifact threshold may be considered to be 5000 units). Content block B4 is considered to have an estimated rate of temperature change of 200 units per unit of time. Block B3 has been determined to have an estimated rate of change in temperature (dT/dt) of 1700 units per accumulation cycle. Thus, after three accumulation cycles, the total accumulated temperature change 388 for block B3 exceeds the threshold of 5000 units of temperature. This triggers a new frame 340. A new temperature baseline for the content block B3 is established as zero and a new estimated rate of change in temperature (dT/dt) is estimated based on the average content of the previous frames for the content block B3. In this case, the estimated rate of change in temperature (dT/dt) for the content block B3 is determined to be 800 units of temperature per accumulation cycle.

Upon receiving a subsequent frame 242, the content of block B4 changes to become much darker. Here, the content of block B4 has an estimated rate in change of temperature per accumulation cycle of −1000 units, resulting in an accumulation of −5000 at point 344, thereby crossing the threshold value of a magnitude of 5000 units of temperature change. This triggers a new frame 346. A new temperature baseline for the content block B4 is established as zero and a new estimated rate of change in temperature (dT/dt) is estimated based on the average content of the previous frames for the content block B4. In this case, the estimated rate of change in temperature (dT/dt) for the content block B4 is now determined to be −700 units of temperature per accumulation cycle. In this way, even for relatively slow refresh rates, rapid changes in temperature may be predicted and visual artifacts based on temperature variation may be avoided.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

displaying frames of image data on an electronic display at a first frame rate; and in response to predicting that a change in content between two frames of the image data would result in a temperature change of the electronic display that would cause a visual artifact on the electronic display, causing the electronic display to refresh sooner than the first frame rate to prevent an appearance of the visual artifact on the electronic display.

2. The method of claim 1, wherein the change in content comprises an increase in brightness that causes the electronic display to increase in temperature over time.

3. The method of claim 1, wherein the change in content comprises a decrease in brightness that causes the electronic display to decrease in temperature over time.

4. The method of claim 1, wherein the change in content between the two frames of image data comprises a change in content of a first subset of the frames of image data, wherein the first subset is less than a whole frame.

5. The method of claim 4, wherein the first subset is more than a single pixel.

6. The method of claim 1, comprising predicting a rate of temperature change based on the change in content between the two frames of image data and predicting when the rate of temperature change would cause enough temperature change over time to result in the visual artifact.

7. The method of claim 6, comprising accumulating a total temperature change since a most recent refresh based on the predicted rate of temperature change and predicting when the rate of temperature change would cause enough temperature change over time to result in the visual artifact when the accumulated total temperature change exceeds a first threshold of temperature increase or falls beneath a second threshold of temperature decrease.

8. The method of claim 1, wherein the content comprises images, videos, text, and any combination thereof.

9. An electronic device comprising:

an electronic display comprising an active area, wherein the active area comprises pixels configured to display image frames based on corresponding image data at a first frame rate; and processing circuitry communicatively coupled to the electronic display, wherein the processing circuitry is configured to:

predict whether content of the image data would produce a temperature change of the electronic display within a time period of the first frame rate that would result in a visual artifact on the electronic display; and in response to predicting that content of the image data would produce the temperature change of the electronic display within the time period of the first frame rate that would result in the visual artifact, cause the electronic display to refresh earlier than the first frame rate to prevent an appearance of the visual artifact on the electronic display.

10. The device of claim 9, wherein the content comprises an area of relatively high brightness to cause the electronic display to increase in temperature within the time period of the first frame rate.

11. The device of claim 9, wherein the content comprises an area of relatively low brightness to cause the electronic display to decrease in temperature within the time period of the first frame rate.

12. The device of claim 9, wherein the temperature change due to the content comprises a temperature change of the electronic display due to a change in content between image frames.

13. The device of claim 12, wherein the temperature change of the electronic display due to the change in content comprises an increase in brightness that would cause the electronic display to increase in temperature within the time period of the first frame rate.

14. The device of claim 12, wherein the temperature change of the electronic display due to the change in content comprises a decrease in brightness that would cause the electronic display to decrease in temperature within the time period of the first frame rate.

15. The device of claim 12, wherein the change in content comprises a change in content of less than an entire image frame.

16. The device of claim 15, wherein the change in content less than the entire image frame comprises a change in more than a single pixel.

17. The device of claim 9, wherein the processing circuitry is configured to:

predict a rate of temperature change of the electronic display based on the content; and predict a point in time when the rate of temperature change would cause enough temperature change over time to result in the visual artifact.

18. The device of claim 17, wherein the processing circuitry is configured to:

accumulate a total temperature change of the electronic display since a most recent refresh based on the predicted rate of temperature change; and predict the point in time when the rate of temperature change would cause enough temperature change over time to result in the visual artifact when the accumulated total temperature change exceeds a first threshold of temperature increase or falls beneath a second threshold of temperature decrease.

19. An article of manufacture comprising one or more tangible, non-transitory, machine-readable media comprising instructions to:

cause frames of image data to be displayed on an electronic display at a first frame rate; and in response to determining that image data content would produce a temperature change of the electronic display within a time period of the first frame rate that would result in a visual artifact, cause the electronic display to refresh earlier than the first frame rate to prevent the visual artifact from appearing on the electronic display.

20. The article of manufacture of claim 19, wherein the image data content comprises a change in content between two frames of image data that causes the electronic display to increase in temperature over time.

21. The article of manufacture of claim 19, wherein the image data content comprises a change in content between two frames of image data that causes the electronic display to decrease in temperature over time.

* * * * *